United States Patent [19]

Kappler et al.

[11] 4,275,564

[45] Jun. 30, 1981

[54] COMBUSTION CHAMBER FOR GAS TURBINE ENGINES

[75] Inventors: Guenter Kappler, Freising; Adolf Fehler, Pfaffing, both of Fed. Rep. of Germany

[73] Assignee: Motoren- und Turbinen Union Munchen GmbH, Munich, Fed. Rep. of Germany

[21] Appl. No.: 28,748

[22] Filed: Apr. 10, 1979

[30] Foreign Application Priority Data

Apr. 13, 1978 [DE] Fed. Rep. of Germany ..... 2815916

[51] Int. Cl.[3] ..... F02C 7/22

[52] U.S. Cl. ..... 60/738; 60/746

[58] Field of Search ..... 60/737, 738, 746

[56] References Cited

U.S. PATENT DOCUMENTS

| | | | |
|---|---|---|---|
| 2,548,087 | 4/1951 | Williams | 60/746 |
| 2,612,023 | 9/1952 | Morrison | 60/738 |
| 2,628,475 | 2/1953 | Heath | 60/738 |
| 2,635,426 | 4/1953 | Meschino | 60/746 |
| 2,693,676 | 11/1954 | Hamm . | |
| 2,782,597 | 2/1957 | Parsons et al. | 60/746 |
| 2,959,006 | 11/1960 | Ferrie | 60/738 |
| 3,961,475 | 6/1976 | Wood | 60/738 |
| 3,968,644 | 7/1976 | Fehler | 60/746 |
| 4,073,137 | 2/1978 | Roberts | 60/737 |

FOREIGN PATENT DOCUMENTS 1079895 4/1960 Fed. Rep. of Germany .

*Primary Examiner*—Robert E. Garrett

*Attorney, Agent, or Firm*—Schwartz, Jeffery, Schwaab, Mack, Blumenthal & Koch

[57] ABSTRACT

Combustion chambers for gas turbine engines and, more particularly, an annular combustion chamber. The combustion chamber comprises a flame tube having a back wall through which several vaporizers project into the flame tube or combustion zone. Each vaporizer has a pipe section extending within the flame tube, fuel supply and also supply ports in communication with the pipe section, and at least one outlet port for supplying a vaporous fuel-air mixture from the pipe section to the flame tube. Outlet ports of adjacent vaporizers are arranged spaced-apart from and facing one another, whereby a zone of maximum turbulence is formed between the outlet ports.

11 Claims, 5 Drawing Figures

COMBUSTION CHAMBER FOR GAS TURBINE ENGINES

BACKGROUND OF THE INVENTION

1. Field of the Invention

The invention relates to combustion chambers for gas turbine engines, particularly to an annular combustion chamber.

2. The Prior Art

U.S. Pat. No. 2,693,676 and German Pat. No. DT-AS 10 79 895 disclose gas turbine engine combustion chambers having T-shaped vaporizer tubes which project into the combustion space of the combustion chamber.

In both disclosures, the respective two outer ends of the vaporizer cross tubes are bent at 90° relative to a longitudinal centerline of the cross tube such that the two outlet ports of each vaporizer are directed towards the back wall of the flame tube.

In this arrangement, the fuel-air mixture flowing in the direction of the flame tube is enriched with primary air forced into the flame tube or the primary zone in a direction countering the flow of the fuel-air mixture. The air is provided by means of air nozzles arranged in the back wall.

In these two disclosures, then, the primary zone eddies, which partially consist of fuel-air components in concentrated gaseous form, will essentially develop only in the area between the flame tube back wall and the vaporizer outlet ports facing said back wall.

In practice it has been shown, however, that the relatively small primary zone eddies developing in the manner just described will not give the stability of flame required in modern gas turbine engines as a result of the relatively high process temperatures and the attending relatively high air-fuel flows and primary air influx velocities.

It has also been shown that combustion chambers of this type, having T-shaped fuel vaporizers, will not adequately permit propagation of a uniform, rotationally symmetrical flame front to be achieved in the interest of a maximally uniform high temperature load and combustion efficiency.

In addition, the vaporizers described above are inherently limited by their inability to vaporize more than 8% to 10% of the incoming fuel.

Considering the high process temperatures at relatively elevated turbine inlet temperatures of about 1300° K. and above which are required for modern gas turbine engines and especially for turbojet engines, fuel vaporization rate achieved with the aid of the above described vaporizers is insufficient to adequately condition the incoming fuel-air mixture for homogeneous, stable combustion.

It should also be noted that such vaporizers are able to handle relatively low fuel-air flows as a result of their design and as a result of the fact that the velocity of the respective combustion air flow that can be handled will essentially remain constant.

A further disadvantage affecting such vaporizers is that fuel tends to carbonize, especially in the bends of the 90-degree angle ends of the vaporizer cross tubes. Apart from the undesirable carbon formed in this manner, engine damage may also be caused, e.g. when carbon deposited at said bends comes loose as a result of certain natural vibrations of these vaporizers.

SUMMARY OF THE INVENTION

In a broad aspect the present invention eliminates the above-mentioned disadvantages and provides a combustion chamber offering stable, homogeneous combustion and the desired high capacity for temperature.

It is a particular object of the present invention to provide a combustion chamber in which outlet ports of two adjacent vaporizers are exactly facing and spaced-apart from one another and in which a zone of maximum turbulence are formed between each pair of facing outlet ports.

In a further advantageous aspect of the present invention, fuel is further intensively treated by vaporization in the heat of the combustion flame in the respective areas between the outlet ports of the vaporizers and the zone of maximum turbulence.

Further objects and advantages of the present invention will become apparent from the following description of the preferred embodiments.

THE PREFERRED EMBODIMENTS

Figure 1:
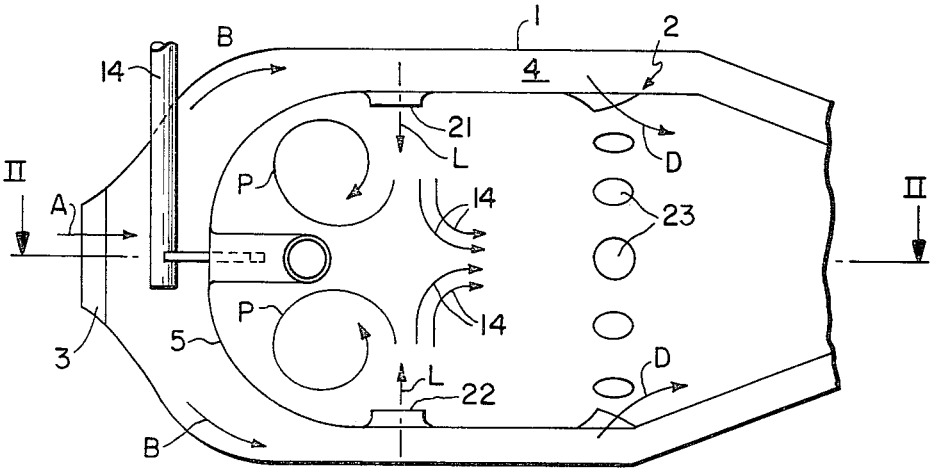
FIG. 1 is a sectional view illustrating a tubular combustion chamber with its downstream end broken away.
Figure 2:
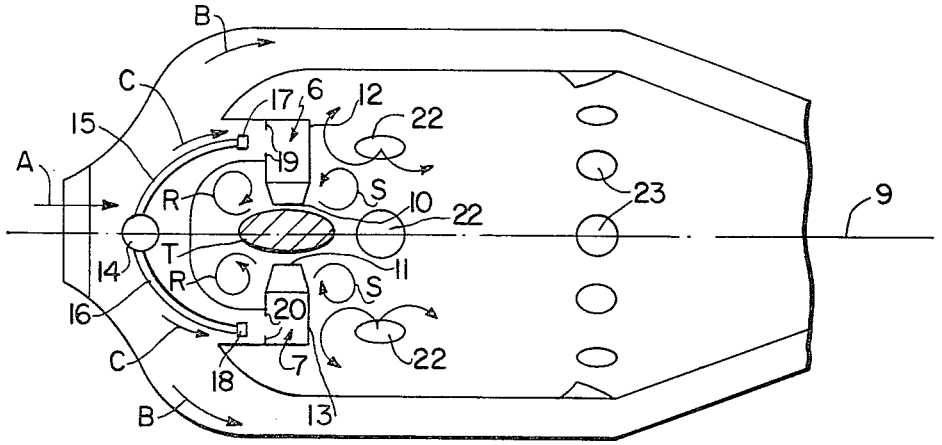
FIG. 2 is a sectional view of the tubular combustion chamber taken along line II—II of FIG. 1.

FIGS. 1 and 2 show a first embodiment of the invention having a tubular combustion chamber. The combustion chamber comprises an outer casing 1 with a flame tube 2 inserted therein. The tubular combustion chamber is pressurized with compressed air (arrow A) from a gas turbine engine (not shown), through a diffuser-type inlet 3.

A portion of the incoming compressor air follows the direction of arrows B into a secondary duct 4 formed between outer casing 1 and flame tube 2. This portion of the air will be routed to the flame tube as combustion and mixing air in a manner to be explained below.

A remaining portion of the compressor air reaching the combustion chamber as indicated by arrow A enters (arrows C of FIG. 2), as combustion air, two vaporizers 6 and 7 which face each other in the horizontal longitudinal center plane (FIG. 2) of the combustion chamber and which are connected to the back wall 5 of the flame tube. The two vaporizers 6, 7 are each bent at an angle of 90° with respect to the longitudinal centerline of the combustion chamber such that their outlet ports 10, 11 in the nozzle-shaped ends of the cross tubes 12, 13 are exactly facing and spaced-apart at a distance from one another.

As shown in FIGS. 1 and 2, a fuel supply line 14 branches off into two small fuel tubes 15, 16 which project into the vaporizers 6, 7 and carry fuel injection nozzles 17, 18.

Nozzles 17, 18 cooperate with baffles 19, 20 inside the vaporizers 6, 7 to intimately mix the portions of fuel and air flowing into the vaporizers. The fuel-air mixture is conditioned additionally within the respective cross tubes 12, 13 where substantial portions of the incoming fuel are vaporized. This fuel vaporization results from the cross tubes picking up a great amount of heat from the combustion process. Fuel precipitating and evaporating on the inner surfaces of the cross tubes is known to cool the cross tubes 12, 13 and prevent their scorching.

In FIG. 2, a zone of maximum turbulence forming as a result of the exactly oppositely arranged outlet ports 12, 13 of vaporizers 6, 7 is indicated by the letter "T".

In an essential aspect of the present invention the fuel is again intensively conditioned during the combustion process by vaporization in the heat of the flame between outlet ports 10, 11 and the zone T of maximum turbulence.

In a further advantageous aspect of the present invention, stable and homogeneous combustion is promoted by the fact that from the indicated zone T of maximum turbulence, not only reaction eddies R circulating towards the back wall of the flame tube but also further reaction eddies S are forming further downstream, the latter developing a little downstream of the two nozzle-ended cross tubes.

Additional air supply holes 21, 22 somewhat downstream of cross tubes 12, 13 (cf. FIG. 1) are advantageous in that they cause reaction eddies S to actually develop in the form roughly outlined in the drawing and keep reaction eddies S from traveling downstream in the direction of the main flow, which, among other disadvantages, would unduly extend the combustion zone in the longitudinal direction.

Air supply holes 21, 22 in flame tube 2 are positioned at the circumference of the flame tube exactly opposite each other, so that air jets L (FIG. 1) directed towards one another within flame tube 2 provide a radial boundary or screen for the reaction zone. The reaction zone terminates downstream of reaction eddies S (FIG. 2). Air jets L (FIG. 2) aimed one against the other as they are, also provide the primary air and mixing air needed to sustain the combustion process. Collision of air jets L one with the other causes primary air eddies P (FIG. 1) to circulate counter to the main flow direction in flame tube 2 to provide reaction eddies R and S (FIG. 2) with the additional combustion air needed, especially with a view to the high thermal load.

To cover part of the required mixing air further portions of air jets L collide with one another and flow in the direction of arrows 14 toward the main flow in flame tube 2.

Through further holes 23, compressed air taken from the secondary duct 4 is routed to flame tube 2 in the direction of arrows D for rarefaction and cooling and for achieving a more uniform temperature profile at the combustion chamber exit.

Figure 3:
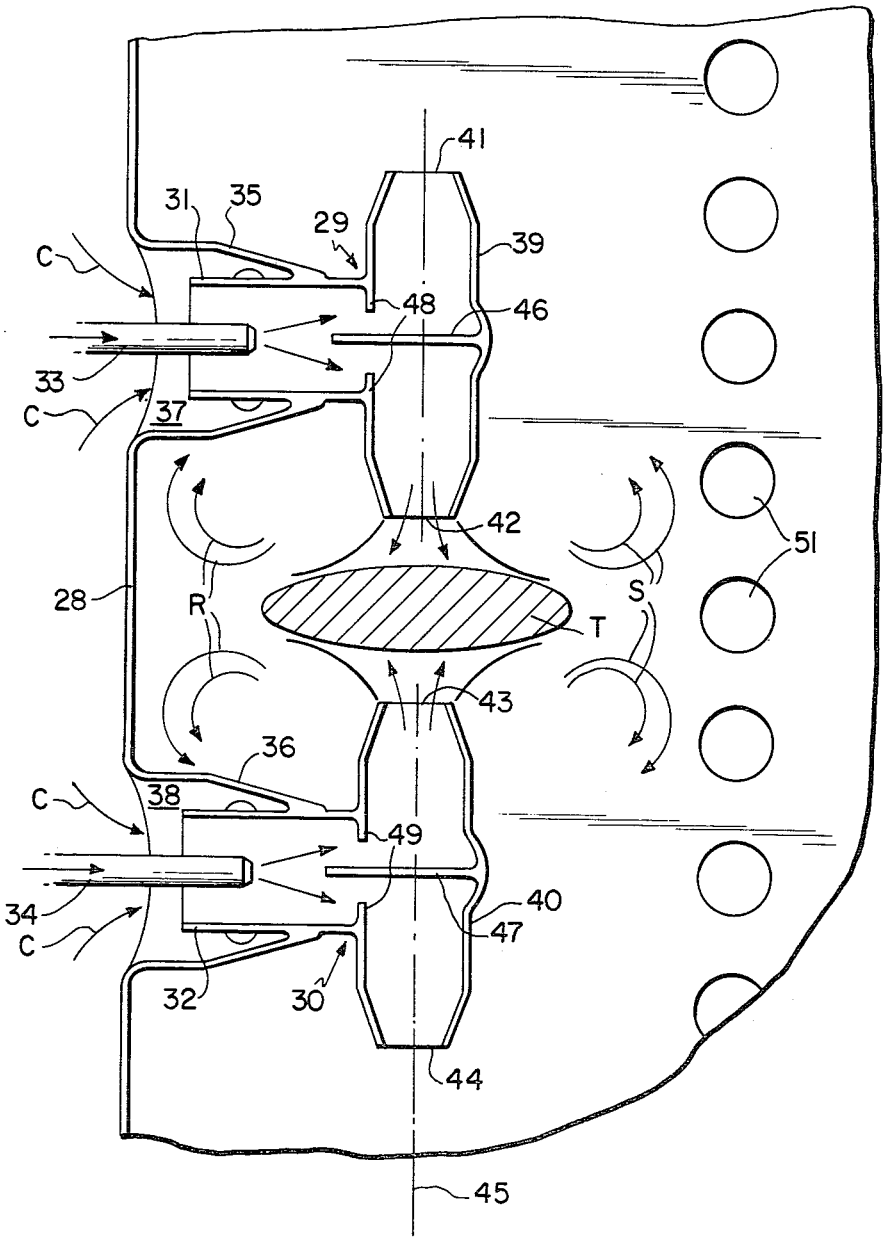
FIG. 3 is a partial, vertical cross-sectional view illustrating two adjacent vaporizers of an annular combustion chamber according to a second embodiment of the invention, looking in direction A of FIG. 4.
Figure 4:
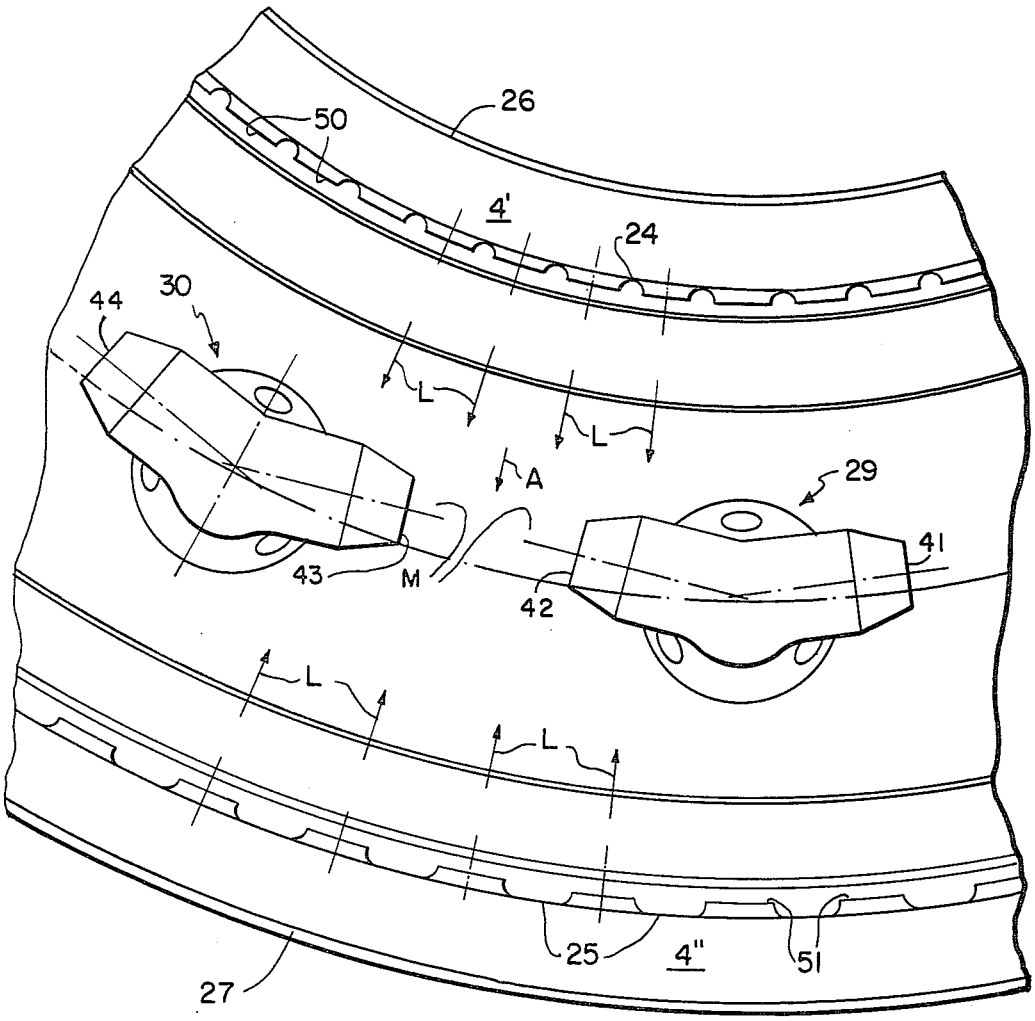
FIG. 4 is a fragmentary sectional view illustrating the annular combustion chamber of FIG. 3.

FIGS. 3 and 4 illustrate a second embodiment of the invention as applied to an annular combustion chamber of a turbojet engine. Referring to FIG. 4, an inner annular flame tube wall is indicated by the numeral 24 and an outer annular flame tube wall by the numeral 25. Numerals 26 and 27 indicate inner and outer casing wall portions, respectively.

Several vaporizers 29, 30 are equally spaced around the circumference of the back wall 28 (FIG. 3) of the flame tube. Each vaporizer 29, 30 comprises a central pipe 31, 32 which extends in parallel to the longitudinal centerline of the combustion chamber and has a separate fuel injection nozzle 33, 34 projecting into it. Each central pipe 31, 32 connects to the back wall 28 of the flame tube through a coaxially-arranged outer shroud 35, 36 such that cooling chambers 37, 38 are formed between pipes 31, 32 and outer shrouds 35, 36. The cooling chambers are pressurized with compressed air and may communicate with reaction eddies R through ports (not shown).

With reference now to FIG. 3, each central pipe 31, 32 terminates in a vaporizer cross tube 39, 40 such that the centers of outlet ports 41, 42 or 43, 44 at the nozzle-ended cross tube sections are in a common plane 45. Plane 45 intersects with and is preferably at a right angle to the longitudinal centerline of the engine or the combustion chamber.

Still referring to FIG. 3, each vaporizer 29, 30 includes a central flow divider 46, 47 attached to the vaporizer cross tube 39, 40 and arranged at a distance downstream of the mouth of the respective fuel injection nozzle 33,34 for equally dividing the fuel-air mixture entering the two lateral branches of the vaporizer cross tubes 39, 40 from the respective central pipe 31, 32.

The vaporizer cross tubes 39, 40 are suitably mounted on central pipes 31, 32 such that a baffle 48, 49, perhaps taking the shape of an annular disk, is formed where central pipe 31, 32 opens into the repective cross tube 39, 40, so that intimate mixing of the incoming fuel with the combustion air (arrows C) will begin inside the central pipe.

As will also be apparent from FIG. 3, adjacent outlet ports, e.g. 42 and 43, are exactly facing one another and spaced apart at a distance such that a zone T of maximum turbulence is formed between each pair of opposingly-arranged outlet ports 42, 43.

Again with reference to FIG. 3, reaction eddies escaping from the zone T of maximum turbulence are again indicated by the letters R and S, comparable to FIG. 2. Air supply holes 50 and 51 in the inner and outer flame tube walls 24 and 25, respectively, provide (as in the embodiment of FIGS. 1 and 2) for enrichment of the mixture with primary air in the direction of arrowheads P in FIG. 1 as well as for the complementing of the mixing air supply following arrowheads 14 of FIG. 1. The opposingly-arranged air supply holes 50, 51 in the flame tube of FIG. 4 serve as a boundary or screen for the reaction zone radially downstream of reaction eddies S, as previously described with reference to FIGS. 1 and 2.

A further advantageous feature of the embodiment of FIGS. 3 and 4 to promote stable and homogeneous combustion is that, apart from the vaporization of fuel taking place inside the respective vaporizer cross tubes 39, 40, fuel is further vaporized and intensively conditioned in the heat of the flame in the respective areas between outlet ports 42, 43 and the zone T of maximum turbulence. It can be seen from FIGS. 3 and 4 that outlet ports 42, 43 have respective center axes which are coaligned as shown at "M" in FIG. 4.

In FIG. 4, numerals 4' and 4" indicate the annuli formed between the inner and outer flame tube walls 24, 25 and the respective adjacent casing wall portions 26, 27. Annuli 4' and 4" are pressurized with compressor air in a direction corresponding to the direction of arrow B in FIG. 1.

Figure 5:
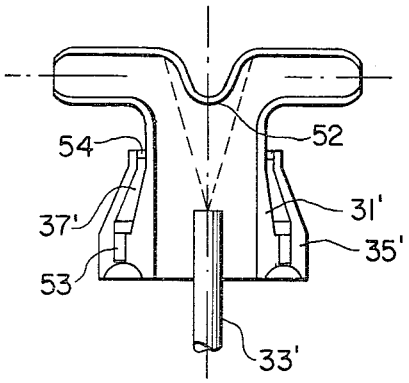
FIG. 5 shows a variation of the type of vaporizer illustrated in FIG. 3.

FIG. 5 illustrates a variation of the vaporizer shown in FIGS. 3 and 4. The difference is essentially that in place of the central baffle used as a flow divider is a central inward bulge 52 of the pipe, the bulge being located between the two lateral legs of the vaporizer cross tube and being aimed at the mouth of injection nozzle 33'. Inward bulge 52 also serves to augment the effective vaporizing surface.

A further variation of the vaporizer illustrated in FIG. 5 includes a cooling duct 37' arranged between central pipe 31' and outer shroud 35'. Cooling duct 37' is pressurized with compressor air through coaxially-arranged holes 53 and is in communication with an annular outlet port 54 surrounding central pipe 31' to provide film cooling at the end of the central pipe.

The function of the vaporizer illustrated in FIG. 5 otherwise corresponds with that of the vaporizers of FIGS. 3 and 4 when suitably incorporated in an annular combustion chamber for gas turbine engines.

We claim:

1. A gas turbine engine, comprising:

a combustion chamber including a flame tube having a back wall;

a plurality of vaporizers projecting through said back wall and into said flame tube, each said vaporizer having at least one pipe section extending within said flame tube, fuel supply and air supply ports in communication with said pipe section, and at least one outlet port for supplying a vaporous fuel-air mixture from said pipe section to said flame tube, wherein first and second said outlet ports of respective, adjacent first and second said vaporizers are arranged spaced-apart from and directly facing one another, said first and second outlet ports having respective center axes which are coaligned, whereby a zone of maximum turbulence is formed between said first and second outlet ports.

2. The apparatus of claim 1, wherein a flame occurs between each of said first and second outlet ports and said zone of maximum turbulence, fuel in said vaporous fuel-air mixture being conditioned by heat from said flame.

3. The apparatus of claim 1, wherein each said outlet port defines an opening having a center, all said outlet port opening centers lying in a common plane intersecting at right angles a longitudinal centerline of said combustion chamber.

4. The apparatus of claim 1, further comprising a cooling air shroud external to each said vaporizer pipe section.

5. The apparatus of claim 1, wherein each said vaporizer comprises a separate fuel injection nozzle extending into said pipe section, said fuel supply port comprising an opening in said fuel injection nozzle.

6. The apparatus of claim 5, wherein each said vaporizer includes two said outlet ports, and said fuel injection nozzle terminates at said nozzle opening upstream of said outlet ports, further comprising central flow dividing means located within said vaporizer downstream of said nozzle opening for dividing said vaporous fuel-air mixture between said two outlet ports.

7. The apparatus of claim 6, wherein said two outlet ports face in approximately mutually-opposing directions.

8. The apparatus of claim 7, wherein said vaporizer includes a cross-tube section approximately perpendicular to and in communication with said pipe section, and said two outlet ports comprise openings in respective ends of said cross-tube section.

9. The apparatus of claim 8, wherein said central flow dividing means comprises an interiorly-extending bulge in said cross-tube, said bulge located adjacent said nozzle opening.

10. The apparatus of one of claims 1 to 5, wherein said flame tube has a reaction zone and a plurality of opposingly-located air supply holes in said flame tube downstream of said reaction zone, whereby air may be supplied through said holes to radially shield said reaction zone downstream of reaction eddies within said zone and to supplement air supplied to said reaction zone.

11. The apparatus of one of claims 1 to 9, wherein said flame tube comprises an annulus defined by inner and outer flame tube walls, said flame tube having a reaction zone and a plurality of opposingly-located air-supply holes in said inner and outer walls downstream of said reaction zone, whereby air may be supplied through said holes to radially shield said reaction zone downstream of reaction eddies within said zone and to supplement air supplied to said reaction zone.

* * * * *